US005582709A

United States Patent [19]

Oshima et al.

[11] Patent Number: 5,582,709

[45] Date of Patent: Dec. 10, 1996

[54] ZINC-COBALT ALLOY-PLATING ALKALINE BATH AND PLATING METHOD USING THE SAME

[75] Inventors: Katsuhide Oshima; Shigemi Tanaka; Toshio Igari; Takeshi Kunihiro, all of Tokyo, Japan

[73] Assignee: Dipsol Chemicals Co., Ltd., Tokyo, Japan

[21] Appl. No.: 317,585

[22] Filed: Oct. 3, 1994

[30] Foreign Application Priority Data

Apr. 14, 1994 [JP] Japan ..... 6-076121

[51] Int. Cl.[6] ..... C25D 5/10; C25D 5/12; C25D 3/56

[52] U.S. Cl. ..... 205/176; 205/177; 205/178; 205/245; 205/255; 205/259; 205/197

[58] Field of Search ..... 205/176, 177, 205/178, 245, 255, 259, 197

[56] References Cited

U.S. PATENT DOCUMENTS 4,048,381 9/1977 Adaniya et al. ..... 205/176
5,194,140 3/1993 Dobrovolskis et al. ..... 205/245

FOREIGN PATENT DOCUMENTS 53-32344 9/1978 Japan .
2-282493 11/1990 Japan .

OTHER PUBLICATIONS

Chemical Abstracts, vol. 91, No. 4, Jul. 23, 1979, abstract No. 29514k, *Doi 'zinc–cobalt electrodeposition from alkaline baths'* , page 587.

*Primary Examiner*—John Niebling
*Assistant Examiner*—Edna Wong
*Attorney, Agent, or Firm*—Oblon, Spivak, McClelland, Maier & Neustadt, P.C.

[57] ABSTRACT

A zinc-cobalt alloy-plating alkaline bath comprises a zinc compound, a cobalt compound, an alkali hydroxide and a reaction product of an alkyleneamine with an alkylene oxide and having a pH of not less than 13 and a method for forming a zinc-cobalt alloy plating film comprises the step of forming, on a substrate, a zinc-cobalt alloy plating film having a cobalt content ranging from 0.05 to 20% by weight and a zinc content ranging from 80 to 99.95 % by weight, while using the foregoing alkaline plating bath. The Zn-Co alloy-plating bath permits the achievement of a desired rate of Co-eutectoid even when a small amount of a chelating agent is incorporated into the bath and therefore, the bath is excellent in the disposability of waste water.

17 Claims, No Drawings

ZINC-COBALT ALLOY-PLATING ALKALINE BATH AND PLATING METHOD USING THE SAME

BACKGROUND OF THE INVENTION

The present invention relates to a zinc-cobalt alloy plating alkaline bath suitable for forming a zinc-cobalt plating layer on a substrate such as parts for automobiles and a method for forming a zinc-cobalt plating layer using the plating bath.

The zinc-cobalt alloy-plating bath is attracting much attention because the bath can provide a plating layer having excellent corrosion resistance at a very low rate of cobalt-eutectoid. Japanese Un-examined Patent Publication No. Hei 2-282493 discloses a zinc-cobalt alloy-electroplating alkaline bath comprising a zinc compound, a cobalt compound, an alkali hydroxide, a chelating compound and a brightener. However, this plating bath suffers from a problem in that the amount of the chelating agent must be increased in order to achieve a rate of cobalt-eutectoid required for forming a plating film showing high corrosion resistance through the use of such a plating bath. Moreover, the plating bath also suffers from other problems of, for instance, operating flexibility, bath control, waste water disposal or treatment and cost for plating.

For this reason, there has been desired for the development of a zinc-cobalt alloy-plating bath and a method for plating a zinc-cobalt alloy layer on parts such as those for automobiles, which permits the solution of the foregoing problems associated with the conventional technique.

SUMMARY OF THE INVENTION

Accordingly, an object of the present invention is to provide a zinc-cobalt alloy-plating bath which permits the formation of a plating film having high corrosion resistance even when a chelating agent is used in a small amount.

Another object of the present invention is to provide a method for plating a zinc-cobalt alloy plating film which permits the formation of a plating film having high corrosion resistance and which makes use of the foregoing plating bath.

These and other objects of the present invention will be clear from the following description and Examples.

The present invention has been developed on the basis of the following findings that if a reaction product of an alkyleneamine and an alkylene oxide is incorporated into an alkaline zinc-cobalt alloy-plating bath comprising a zinc compound, a cobalt compound and an alkali hydroxide, the reaction product acts as not only a chelating compound, but also as a brightener and thus cobalt can easily be deposited, that as a result, cobalt ions are steadily dissolved in the zinc plating bath and easily be electro-deposited and that the waste water derived from a Zn-Co alloy-plating bath can easily be post-treated and discharged.

According to an aspect of the present invention, there is provided a zinc-cobalt alloy-plating alkaline bath which comprises a zinc compound, a cobalt compound, an alkali hydroxide and a reaction product of an alkyleneamine with an alkylene oxide and whose pH value is not less than 13.

According to another aspect of the present invention, there is provided a method for forming a zinc-cobalt alloy plating film which comprises the step of forming, on a substrate, a zinc-cobalt alloy plating film, which preferably has a cobalt content ranging from 0.05 to 20% by weight and a zinc content ranging from 80 to 99.95% by weight, while using the foregoing alkaline plating bath.

DESCRIPTION OF THE PREFERRED EMBODIMENTS

The present invention will hereinafter be detailed below in connection with preferred embodiments.

The plating bath of the present invention is a strongly alkaline bath which comprises a known alkaline zincate zinc plating bath, as a basic bath, in which cobalt ions are dissolved so that they can be electrodeposited on a substrate in the presence of a chelating agent and whose pH is adjusted to a level of not less than 13.

The zinc compound usable in the present invention may be any zinc compound so far as they can release zinc ions into an alkaline bath having a pH of not less than 13 and may be, for instance, zinc white, zinc sulfate, zinc chloride or mixture thereof. The Zn ion content in the plating bath may arbitrarily be selected, but preferably ranges from 2 to 40 g/l and more preferably 5 to 15 g/l as expressed in terms of the amount of elemental Zn.

The cobalt compound usable in the present invention may be any cobalt compound so far as they can release Co ions into an alkaline bath having a pH of not less than 13 and may be, for instance, cobalt sulfate, cobalt chloride or mixture thereof. The Co ion content in the plating bath may arbitrarily be selected, but preferably ranges from 0.01 to 10 g/l and more preferably 0.05 to 1.0 g/l as expressed in terms of the amount of elemental Co.

The alkali hydroxide usable in the present invention may be, for instance, NaOH and/or KOH. The concentration thereof is adjusted such that the pH value of the alkaline bath can be controlled to not less than 13, but preferably selected so as to fall within the range of from 30 to 200 g/l.

The reaction product of an alkyleneamine with an alkylene oxide used in the invention serves as not only a chelating agent, but also a brightener in the zinc-cobalt alloy-plating bath of the invention. Examples of such reaction products include those each prepared through the reaction of an alkyleneamine having 2 to 12 carbon atoms with an alkylene oxide having 2 to 4 carbon atoms. Among these, preferred are those each prepared by reacting an alkyleneamine selected from the group consisting of ethylenediamine, propylenediamine, butylenediamine, diethylenetriamine, dipropylenetriamine, triethylenetetramine, tripropylenetetramine, tetraethylenepentamine, tetrapropylenepentamine and pentaethylenehexamine with an alkylene oxide selected from the group consisting of ethylene oxide, propylene oxide and butylene oxide in an amount of 0.5 to 4 mole per mole of the alkyleneamine. In this connection, the alkylene oxide has no halogen atom in its molecule.

The reaction product of an alkyleneamine with an alkylene oxide may be used in any amount in the alkaline bath of the invention, but may be used in an amount ranging from 0.05 to 100 g/l depending on the predetermined rate of Co-eutectoid and the amount thereof desirably ranges from 0.2 to 5 g/l while taking into consideration of the ability of treating waste water.

The zinc-cobalt alloy-plating bath according to the present invention may also comprise conventionally known chelating agents and/or brighteners. Examples of such chelating agents include aminoalcohols such as diethanolamine and triethanolamine; polyamines such as diethylenetriamine and triethylenetetramine; aminocarboxylic acid salts such as ethylenediaminetetraacetic acid salts and nitrilotriacetic acid salts; salts of oxycarboxylic acids such as citric acid salts, tartaric acid salts, gluconic acid salts and glycolic acid salts; polyhydric alcohols such as sorbit and pentaerythritol; and mixture thereof. The concentration thereof may arbitrarily be selected, but preferably ranges from 1 to 200 g/l.

Moreover, examples of brighteners are those used in known Zn or zn alloy-plating baths such as a reaction product of diethylenetriamine with epichlorohydrin; reaction products of nitrogen atom-containing heterocyclic compounds with epihalohydrins as disclosed in Japanese Examined Patent Publication No. Sho 53-32344; and aromatic aldehydes such as vanillin and benzaldehyde, which may be used alone or in any combination. The brighteners of this kind are easily commercially available from, for instance, Dipsol Co., Ltd. under the trade names of NZ-71S, NZ-65S and IZ-260S.

If the reaction product of an alkyleneamine with an alkylene oxide is used as a brightener, the chelating agent may be a gluconic acid salt, a tartaric acid salt, a citric acid salt, an aliphatic amine and an aminoalcohol, but they are not preferred so much since they may impair the ability of treating waste water resulting from the plating bath. It is rather preferred to use the reaction products of alkyleneamines with alkylene oxides as chelating agents and to use the foregoing brighteners simultaneous with the reaction products. In this respect, the concentration of the brightener is preferably adjusted to the range of from 0.1 to 2 g/l.

The plating bath of the present invention comprises the foregoing components as the essential ingredients and the balance of water and may optionally comprise, for instance, an aromatic aldehyde for the improvement of brighteneing properties of the bath.

The present invention further relates to a method for forming a zinc-cobalt alloy plating film which comprises the step of forming, on a substrate, a zinc-cobalt alloy plating film which preferably has a cobalt content ranging from 0.05 to 20% by weight and a zinc content ranging from 80 to 99.95% by weight, while using the foregoing alkaline plating bath. More specifically, the foregoing method permits the formation of a zinc-cobalt alloy plate film on a substrate by passing an electric current ranging from 0.1 to 10 A/dm$^2$ through the substrate serving as a cathode and a zinc, iron or stainless steel plate serving as an anode at a temperature of 15° to 35° C. for 5 to 120 minutes.

Examples of substrates to be plated by the method include substances or articles made of iron, copper and copper alloys as well as castings. The method of the present invention permits the formation of a zinc-cobalt alloy plating film having a thickness ranging from 0.1 to 80μ. In this respect, the ratio of the deposited zinc to cobalt can arbitrarily be controlled by appropriately adjusting the ratio of zinc to cobalt present in the plating bath, but the resulting zinc-cobalt alloy plating film preferably has a cobalt content ranging from 0.05 to 20% by weight, in particular 0.5 to 5% by weight and a zinc content ranging from 80 to 99.95% by weight, in particular 95 to 99.5% by weight. In this connection, the thickness of zinc-cobalt alloy plating film to be formed on the substrate is not particularly limited, but the thickness may be preferably in the range of 3 to 15 μm.

After the substrate is plated by the method of the present invention to form a zinc-cobalt alloy plating film thereon, a corrosion-resistant chromate treatment can be further applied to the resulting substrate by the conventional method to form a corrosion-resistant film thereon. In this case, the kinds of chromates (for instance, the rate of sulfate or chloride residue to chromic acid) must be changed depending on the composition of the alloy to be formed and the intended appearance or color of the chromate film. In any case, an excellent chromate film can be formed when the content of Co in the zinc-cobalt alloy plating film is selected so as to fall within the range of from 0.05 to 20% by weight and excellent corrosion resistance can be imparted to the substrate.

The Zn-Co alloy-plating bath of the present invention permits the achievement of a desired rate of Co-eutectoid even when a small amount of a chelating agent is incorporated into the bath, unlike the conventional zn-Co alloy-plating baths and therefore, the bath of the invention is excellent in the disposability of waste water.

The Zn-Co alloy-plating bath and the plating method which makes use of the plating bath according to the present invention are quite suitable as a surface-treating technique in various fields such as automobile industries.

The present invention will be explained in more detail with reference to the following non-limitative working Examples and the effects practically accomplished by the present invention will also be discussed in detail in comparison with Comparative Examples. In the following Examples and Comparative Examples, all of the plating operations were carried out under the conditions defined below using a 267 ml Hull cell:

Electric Current: 2A; Plating Time: 15 minutes; Bath Temperature: 25° C.; Anode: zinc plate; Cathode: polished steel plate. Example 1

The composition of the bath used herein is as follows: NaOH: 150 g/l; $ZnCl_2$: 20.9 g/l; $CoSO_4 \cdot 7H_2O$: 0.25 g/l (Zn: 10 g/l; Co: 0.05 g/l); the product obtained by reacting one mole of dipropylenetriamine with three moles of butylene oxide: 2 g/l; brightener, IZ-260S: 5 ml/l. In this connection, IZ-260S is an aqueous solution comprising 2% by weight of vanilin and 20% by weight of a reaction product of aliphatic amine with epichlorohydrin.

As a result of the Hull cell test, it was found that the whole surface of the test piece was covered with a uniform plating film having good brightness and a thickness of about 5 μm. The rate of Co-eutectoid at the center of the test piece was found to be 0.16% by weight.

The test piece which had been plated with the foregoing plating bath was treated with a 50 ml/l solution of black chromate (available from Dipsol Co., Ltd. under the trade name of P-1113) and thus a black chromate film having good appearance was formed on the test piece.

Example 2

The composition of the bath used herein is as follows: NaOH: 120 g/l; $ZnCl_2$: 20.9 g/l; $CoCl_2$: 0.22 g/l (Zn: 10 g/l; Co: 0.1 g/l); the product obtained by reacting one mole of triethylenetetramine with one mole of propylene oxide: 2 g/l; brightener, IZ-260S: 5 ml/l.

As a result of the Hull cell test, it was found that the whole surface of the test piece was covered with a uniform plating film having good brightness. The rate of Co-eutectoid at the center of the test piece was found to be 0.64% by weight.

The test piece which had been plated with the foregoing plating bath was treated with a 10 ml/l solution of colored chromate (available from Dipsol Co., Ltd. under the trade name of Z-493) and thus a colored chromate film having excellent appearance was formed on the test piece.

Example 3

The composition of the bath used herein: NaOH: 120 g/l; ZnO: 10 g/l; $CoCl_2$: 0.22 g/l (Zn: 8 g/l; Co: 0.1 g/l); the product obtained by reacting one mole of diethylenetriamine with 4 moles of ethylene oxide: 4 g/l; brightener, IZ-260S: 5 ml/l.

As a result of the Hull cell test, it was found that the whole surface of the test piece was covered with a uniform plating film having good brightness. The rate of Co-eutectoid at the center of the test piece was found to be 1.05% by weight.

The test piece which had been plated with the foregoing plating bath was treated with a solution containing 10 g/l of $CrO_3$ 10 g/l of NaCl, 5 g/l of succinic acid and 1 g/l of $Na_2SO_4$ and thus a black chromate film having excellent appearance was formed on the whole surface of the test piece.

Example 4

The composition of the bath used herein: NaOH: 100 g/l; ZnO: 12.5 g/l; $CoCl_2$: 1.1 g/l (Zn: 10 g/l; Co: 0.5 g/l); the product obtained by reacting one mole of pentaethylenehexamine with 2 moles of ethylene oxide: 5 g/l; brightener, IZ-260S: 5 ml/l.

As a result of the Hull cell test, it was found that the whole surface of the test piece was covered with a uniform plating film having good brightness. The rate of Co-eutectoid at the center of the test piece was found to be 3.11% by weight.

The test piece which had been plated with the foregoing plating bath was treated with a solution containing 10 g/l of $CrO_3$, 10 g/l of NaCl and 5 g/l of formic acid and thus a black chromate film having excellent appearance was formed on the whole surface of the test piece.

Example 5

The composition of the bath used herein: NaOH: 120 g/l; ZnO: 10 g/l; $CoCl_2 \cdot 6H_2$: 0.4 g/l (Zn: 8 g/l; Co: 0.1 g/l); the product obtained by reacting one mole of tetraethylenepentamine with 2 moles of ethylene oxide: 0.5 g/l; brightener, IZ-260S: 5 ml/l.

As a result of the Hull cell test, it was found that the whole surface of the test piece was covered with a uniform plating film having good brightness. The rate of Co-eutectoid at the center of the test piece was found to be 1.03% by weight.

The test piece which had been plated with the foregoing plating bath was treated with a solution containing 10 g/l of $CrO_3$, 20 g/l of NaCl and 5 g/l of formic acid and thus a black chromate film having good appearance was formed on the whole surface of the test piece.

Example 6

The composition of the bath used herein: NaOH: 120 g/l; ZnO: 10 g/l; $CoCl_2$: 22 g/l (Zn: 8 g/l; Co: 10 g/l); the product obtained by reacting one mole of diethylenetriamine with one mole of ethylene oxide: 100 g/l; brightener, IZ-260S: 5 ml/l.

As a result of the Hull cell test, it was found that the whole surface of the test piece was covered with a uniform plating film having good brightness. The rate of Co-eutectoid at the center of the test piece was found to be 16.8% by weight.

The test piece which had been plated with the foregoing plating bath was treated with a solution containing 10 g/l of $CrO_3$, 5 g/l of NaCl and 5 g/l of succinic acid and thus a black chromate film having excellent appearance was formed on the whole surface of the test piece.

Example 7

The composition of the bath used herein: NaOH: 120 g/l; ZnO: 10 g/l; $CoCl_2$: 0.11 g/l (Zn: 8 g/l; Co: 0.05 g/l); the product obtained by reacting one mole of pentaethylenehexamine with 3 moles of ethylene oxide: 0.2 g/l; brightener, IZ-260S: 5 ml/l.

As a result of the Hull cell test, it was found that the whole surface of the test piece was covered with a uniform plating film having good brightness. The rate of Co-eutectoid at the center of the test piece was found to be 0.05% by weight.

The test piece which had been plated with the foregoing plating bath was treated with a solution containing 10 g/l of $CrO_3$, 20 g/l of NaCl and 5 g/l of succinic acid and thus a black chromate film having excellent appearance was formed on the whole surface of the test piece.

COMPARATIVE EXAMPLE 1

The post-treating ability and disposability (hereinafter simply referred to as "disposability") of waste water derived from the plating bath of Example 3 (rate of Co-eutectoid: 1.05% by weight) was compared with that of waste water derived from the plating bath (rate of Co-eutectoid: 1.14% by weight) disclosed in Japanese Un-examined Patent Publication No. Hei 2-282493 having the following composition:

NaOH: 160 g/l; ZnO: 10 g/l; $CoSO_4 \cdot 7H_{2O}$: 0.5 g/l; sodium gluconate: 20 g/l; vanillin: 0.02 g/l.

Methodology

One liter each of plating bath samples was prepared and diluted 100 times while taking into consideration of the usual waste water. Fe, Cu, Ni, Cr and Zn were added to each bath sample to a concentration of 100 mg/l expressed in terms of metal ion concentration. The pH value thereof was adjusted to 9 through addition of $H_2SO_4$ and then they were allowed to stand for 3 hours to thus precipitate heavy metal ions. Thereafter, the precipitates were filtered off followed by determination of the concentrations of the heavy metal ions remaining in the filtrate using an atomic absorption photometer.

In Comparative Example 1, the disposability was determined using waste water derived from the bath sample from which the brightener, LZ-50RMU was removed. In addition, BOD and COD were likewise compared between these samples. The results thus observed are summarized in the following Table 1.

TABLE 1

| | (Unit: mg/l) | | | | | | |
|---|---|---|---|---|---|---|---|
| | Fe | Cu | Zn | Ni | Cr | COD | BOD |
| Comparative Example 1 | 55 | 60 | 65 | 50 | 45 | 100 | 127 |
| Example 3 | ≦0.1 | 3 | ≦0.1 | 0.5 | ≦0.1 | 20 | 23 |

What is claimed is:

1. A zinc-cobalt alloy-plating alkaline bath comprising a zinc compound, a cobalt compound, an alkali hydroxide and a reaction product of an alkyleneamine with an alkylene oxide , and wherein said alkylene oxide is selected from the group consisting of ethylene oxide, propylene oxide and butylene oxide and having a pH of not less than 13.

2. The zinc-cobalt alloy-plating alkaline bath of claim 1 wherein the reaction product is prepared through a reaction of an alkyleneamine having 2 to 12 carbon atoms with said alkylene oxide.

3. The zinc-cobalt alloy-plating alkaline bath of claim 2 wherein the alkyleneamine is reacted with the alkylene oxide in an amount of 0.5 to 4 mole of alkylene said oxide per mole of said alkyleneamine.

4. The zinc-cobalt alloy-plating alkaline bath of claim 1 wherein the amount of the reaction product of an alkyleneamine with an alkylene oxide ranges from 0.05 to 100 g/l.

5. The zinc-cobalt alloy-plating alkaline bath of claim 4 wherein the amount of the reaction product of an alkyleneamine with an alkylene oxide ranges from 0.2 to 5 g/l.

6. The zinc-cobalt alloy-plating alkaline bath of claim 1 wherein the bath has a Zn ion content ranging from 2 to 40 g/l as expressed in terms of an amount of elemental Zn and a Co ion content ranging from 0.01 to 10 g/l as expressed in terms of an amount of elemental Co.

7. The zinc-cobalt alloy-plating alkaline bath of claim 1 wherein the bath comprises 30 to 200 g/l of the alkali hydroxide.

8. The zinc-cobalt alloy-plating alkaline bath of claim 1 wherein the bath comprises a balance of water.

9. A zinc-cobalt alloy-plating alkaline bath comprising a zinc compound in an amount of 2 to 40 g/l as expressed in terms of an amount of elemental Zn, a cobalt compound in amount of 0.01 to 10 g/l as expressed in terms of an amount of elemental Co, an alkali hydroxide in an amount of 30 to 200 g/l, a reaction product of an alkyleneamine having 2 to 12 carbon atoms with an alkylene oxide selected from the group consisting of ethylene oxide, propylene oxide and butylene oxide in an amount of 0.05 to 100 g/l and a balance of water and having a pH of not less than 13.

10. The zinc-cobalt alloy-plating alkaline bath of claim 9 wherein the alkyleneamine is reacted with the alkylene oxide in an amount of 0.5 to 4 mole of alkylene said oxide per mole of said alkyleneamine.

11. A method for forming a zinc-cobalt alloy plating film comprising the step of forming, on a subtrate by passing an electric current ranging from 0.1 to 10 A/dm$^2$, a zinc-cobalt alloy plating film having a cobalt content ranging from 0.05 to 20% by weight and a zinc content ranging from 80 to 99.95% by weight, while using an alkaline plating bath which comprises a zinc compound, a cobalt compound, an alkali hydroxide and a reaction product of an alkyleneamine with an alkylene oxideg, and wherein said alkylene oxide is selected from the group consisting of ethylene oxide, propylene oxide and butylene oxide and having a ph of not less than 13.

12. The method of claim 11 wherein the zinc-cobalt alloy plating film is formed by passing an electric current ranging from 0.1 to 10 A/dm$^2$ through the substrate serving as a cathode and a zinc, iron or stainless steel plate serving as an anode at a temperature of 15° to 35° C. for 5 to 120 minutes.

13. The method of claim 11 wherein the reaction product is one prepared through a reaction of an alkyleneamine having 2 to 12 carbon atoms with said alkylene oxide.

14. The method of claim 13 wherein the alkyleneamine is reacted with the alkylene oxide in an amount of 0.5 to 4 mole of alkylene said oxide per mole of said alkyleneamine.

15. The method of claim 11 wherein the amount of the reaction product of an alkyleneamine with an alkylene oxide ranges from 0.05 to 100 g/l.

16. The method of claim 11 wherein the bath comprises a zinc compound in an amount of 2 to 40 g/l as expressed in terms of an amount of elemental Zn, a cobalt compound in amount of 0.01 to 10 g/l as expressed in terms of an amount of elemental Co, an alkali hydroxide in an amount of 30 to 200 g/l, a reaction product of an alkyleneamine having 2 to 12 carbon atoms with said alkylene oxide in an amount of 0.05 to 100 g/l and a balance of water and having a pH of not less than 13.

17. The method of claim 11 wherein it further comprising the step of subjecting the resulting substrate having the zinc-cobalt alloy plating film on its surface to a corrosion-resistant chromate treatment.

* * * * *